US011104408B2

(12) United States Patent
Miyashita

(10) Patent No.: US 11,104,408 B2
(45) Date of Patent: Aug. 31, 2021

(54) STEERING DEVICE FOR OUTBOARD MOTOR

(71) Applicant: SUZUKI MOTOR CORPORATION, Hamamatsu (JP)

(72) Inventor: Yasushi Miyashita, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 46 days.

(21) Appl. No.: 16/671,957

(22) Filed: Nov. 1, 2019

(65) Prior Publication Data

US 2020/0189708 A1 Jun. 18, 2020

(30) Foreign Application Priority Data

Dec. 18, 2018 (JP) ..... JP2018-236584

(51) Int. Cl.
*B63H 20/06* (2006.01)
*B63H 20/32* (2006.01)
*B63H 20/12* (2006.01)

(52) U.S. Cl.
CPC ..... *B63H 20/06* (2013.01); *B63H 20/12* (2013.01); *B63H 20/32* (2013.01)

(58) Field of Classification Search
CPC ..... B63H 20/06; B63H 20/12; B63H 20/32
See application file for complete search history.

(56) References Cited

U.S. PATENT DOCUMENTS 5,244,426 A * 9/1993 Miyashita ..... B63H 21/265 114/144 R
6,276,977 B1 * 8/2001 Treinen ..... B63H 20/12 114/150
6,402,577 B1 * 6/2002 Treinen ..... B63H 20/12 440/61 C
7,311,571 B1 * 12/2007 Swan ..... B63H 20/10 440/53
8,133,084 B2 * 3/2012 Murai ..... B63H 21/265 440/61 S
8,833,725 B1 * 9/2014 Anderson ..... B63H 20/02 248/643
8,840,439 B1 * 9/2014 Wiatrowski ..... B63H 20/12 440/61 T
8,851,944 B1 * 10/2014 Wiatrowski ..... B63H 20/08 440/61 G (Continued)

*Primary Examiner* — S. Joseph Morano
*Assistant Examiner* — Jovon E Hayes
(74) *Attorney, Agent, or Firm* — Stein IP, LLC

(57) ABSTRACT

There is provided a steering device of an outboard motor to be attached to a boat hull. A swivel bracket to be attached to a side of the boat hull supports a steering shaft to which an outboard motor main body is connected. A steering actuator is disposed above the swivel bracket and the steering actuator generates power in accordance with input from outside. A power transmission mechanism is disposed above the swivel bracket to connect the steering actuator to the steering shaft. The power transmission mechanism transmits the power of the steering actuator to the steering shaft. A cover member is attached to an upper portion of the swivel bracket to cover the steering actuator, the power transmission mechanism, a connection part between the steering actuator and the power transmission mechanism, and a connection part between the power transmission mechanism and the steering shaft.

16 Claims, 12 Drawing Sheets

(56) References Cited

U.S. PATENT DOCUMENTS

| | | | | |
|---|---|---|---|---|
| 9,233,743 | B2 * | 1/2016 | Daikoku | B63H 20/32 |
| 9,772,014 | B2 * | 9/2017 | Takase | B63H 20/10 |
| 10,696,368 | B2 * | 6/2020 | Mizutani | B63H 25/02 |
| 10,696,369 | B2 * | 6/2020 | Takase | F02B 61/045 |
| 2007/0243777 | A1 * | 10/2007 | Hasegawa | B63H 21/213 440/84 |
| 2010/0145558 | A1 * | 6/2010 | Kaji | B63B 79/40 701/21 |
| 2012/0286129 | A1 * | 11/2012 | Daikoku | B63H 21/20 248/642 |
| 2016/0318592 | A1 * | 11/2016 | Mizutani | B63H 25/52 |
| 2017/0113772 | A1 * | 4/2017 | Kumita | B63H 20/32 |
| 2019/0185124 | A1 * | 6/2019 | Tokuda | B63H 20/10 |
| 2019/0344870 | A1 * | 11/2019 | Mizutani | B63H 20/10 |
| 2019/0344871 | A1 * | 11/2019 | Takase | B63H 20/12 |
| 2019/0344872 | A1 * | 11/2019 | Nanjo | B63H 20/12 |
| 2020/0189708 | A1 * | 6/2020 | Miyashita | B63H 20/06 |

* cited by examiner

STEERING DEVICE FOR OUTBOARD MOTOR

CROSS-REFERENCE TO RELATED APPLICATIONS

The disclosure of Japanese Patent Application No. 2018-236584 filed on Dec. 18, 2018, including specification, drawings and claims is incorporated herein by reference in its entirety.

TECHNICAL FIELD

The present disclosure relates to a steering device for an outboard motor.

BACKGROUND

An outboard motor includes an outboard motor main body provided with an engine and a propeller, a swivel bracket that rotatably supports the outboard motor main body in a horizontal direction using a steering shaft as a rotation shaft, and a clamp bracket that fixes the swivel bracket to a transom of a boat hull. In addition, the outboard motor may include a hydraulic cylinder device that controls steering of the boat hull by rotating the outboard motor main body in the horizontal direction.

The hydraulic cylinder device has an axially long shape because of the structure in which a piston moves in the cylinder in an axial direction of the cylinder. When the hydraulic cylinder device is disposed at a stern such that the axial direction of the hydraulic cylinder device is a right-left direction of the boat hull, it is necessary to ensure a space on a left side or a right side of the outboard motor in consideration of an extension amount of a piston rod. Therefore, for example, when two or more outboard motors are disposed at the stern side by side in the right-left direction, a large space must be ensured at the stern in the right-left direction. When the hydraulic cylinder device is disposed at the stern such that the axial direction of the hydraulic cylinder device is a front-back direction of the boat hull, the hydraulic cylinder device projects from the transom toward a bow side of the boat hull. Due to the overhang of the hydraulic cylinder device, a boarding space and a loading space on the stern side of the boat hull become narrow.

The following Patent Document 1 discloses a hydraulic steering device in which a hydraulic cylinder is disposed between an engine cover of an outboard motor main body and a swivel bracket such that an axial direction of the hydraulic cylinder is a right-left direction of a boat hull, and the hydraulic cylinder and the swivel bracket are integrally formed on an upper side of the swivel bracket. According to the hydraulic steering device, the hydraulic cylinder is disposed such that the axial direction is the right-left direction of the boat hull, so that the hydraulic cylinder can be prevented from projecting from the stern to a bow side. According to the hydraulic steering device, the hydraulic cylinder and the swivel bracket are integrally formed on the upper portion of the swivel bracket, so that the steering device of the outboard motor or the outboard motor can be downsized.

Patent Document 1: U.S. Pat. No. 7,311,571 B1

However, the steering device described in Patent Document 1 has the following problems. In the steering device described in Patent Document 1, a part of a steering arm, which transmits power of the hydraulic cylinder to a tube functioning as a steering shaft, passes through an opening formed in the hydraulic cylinder, and is exposed to the outside of the swivel bracket from the inside of the hydraulic cylinder integrally formed on the swivel bracket (see, FIGS. 4 and 8 of Patent Document 1). A front end side of the steering arm moves in the right-left direction in accordance with the movement of a piston member provided in the hydraulic cylinder. In order to enable the movement of the steering arm, the opening of the hydraulic cylinder has a shape elongated in the right-left direction, and the dimension thereof in the right-left direction is significantly larger than the diameter of the steering arm. In addition, the opening is covered with a rubber elastic cover and sealed. An insertion hole having a diameter equal to the diameter of the steering arm is formed in the rubber elastic cover, and the steering arm is inserted into the insertion hole.

In this way, in the steering device described in Patent Document 1, a part of the steering arm, which is a movable part that moves in accordance with the movement of the piston member, passes through the opening having a diameter substantially larger than the diameter of the steering arm and is exposed to the outside of the swing bracket. Accordingly, seawater or the like is likely to infiltrate into the hydraulic cylinder from the above opening. In addition, the above opening is sealed by the rubber elastic cover. However, the rubber elastic cover is likely to be deteriorated or damaged due to repeated deformation with rotation of the steering arm. When the rubber elastic cover is deteriorated or damaged, a gap is formed between the rubber elastic cover and the opening or between the insertion hole formed in the rubber elastic cover and the steering arm, and thus seawater or the like may infiltrate into the hydraulic cylinder from the gap.

SUMMARY

It is therefore at least one of objects of the present disclosure to provide a steering device for an outboard motor, which can miniaturize a steering device or an outboard motor and prevent water such as seawater from infiltrating into a steering actuator.

According to an aspect of the embodiments of the present disclosure, there is provided a steering device of an outboard motor configured to be attached to a boat hull, the steering device comprising: a steering shaft to which an outboard motor main body is connected; a swivel bracket configured to be attached to a side of the boat hull and supporting the steering shaft; a steering actuator disposed above the swivel bracket and configured to generate power in accordance with input from outside; a power transmission mechanism disposed above the swivel bracket, connecting the steering actuator to the steering shaft, and configured to transmit the power of the steering actuator to the steering shaft; and a cover member attached to an upper portion of the swivel bracket to cover the steering actuator, the power transmission mechanism, a connection part between the steering actuator and the power transmission mechanism, and a connection part between the power transmission mechanism and the steering shaft.

With the above configuration, a steering device or an outboard motor can be downsized, and water such as seawater can be prevented from infiltrating into a steering actuator, and the durability against water can be improved.

DETAILED DESCRIPTION OF THE EMBODIMENTS

A steering device according to an embodiment of the present disclosure is used for an outboard motor attached to a boat hull. The steering device includes a steering shaft to which an outboard motor main body is connected, and a swivel bracket configured to be attached to a side of the boat hull and supporting the steering shaft. The steering device further includes a steering actuator configured to generate power in accordance with input from the outside, and a power transmission mechanism connecting the steering actuator to the steering shaft and configured to transmit the power of the steering actuator to the steering shaft. The steering device further includes a cover member attached to an upper portion of the swivel bracket.

In the steering device according to the embodiment of the present disclosure, both the steering actuator and the power transmission mechanism are disposed above the swivel bracket. Further, the steering actuator, the power transmission mechanism, a connection part between the steering actuator and the power transmission mechanism, and a connection part between the power transmission mechanism and the steering shaft are all covered by the cover member.

According to the steering device of the embodiment of the present disclosure, by attaching the cover member to the upper portion of the swivel bracket, a liquid-tight space can be formed between the upper portion of the swivel bracket and the cover member. Further, the space can accommodate the steering actuator, the power transmission mechanism, the connection part between the steering actuator and the power transmission mechanism, and the connection part between the power transmission mechanism and the steering shaft. Not only the steering actuator and the connection part between the steering actuator and the power transmission mechanism but also the power transmission mechanism, and the connection part between the power transmission mechanism and the steering shaft can be accommodated in the liquid-tight space between the upper portion of the swivel bracket and the cover member. Accordingly, an effect of preventing water such as seawater from infiltrating into the steering actuator can be enhanced.

According to the steering device of the embodiment of the present disclosure, the steering device and the outboard motor can be downsized by accommodating the steering actuator and the power transmission mechanism on the upper portion of the swivel bracket.

Embodiment

An embodiment of the steering device according to the present disclosure will be described below. In the description of the configuration or operation of the steering device and the like, arrows illustrated in lower parts of the figures represent a front direction (F), a back direction (B), an upper direction (U), a lower direction (D), a left direction (L), and a right direction (R).

Figure 1:
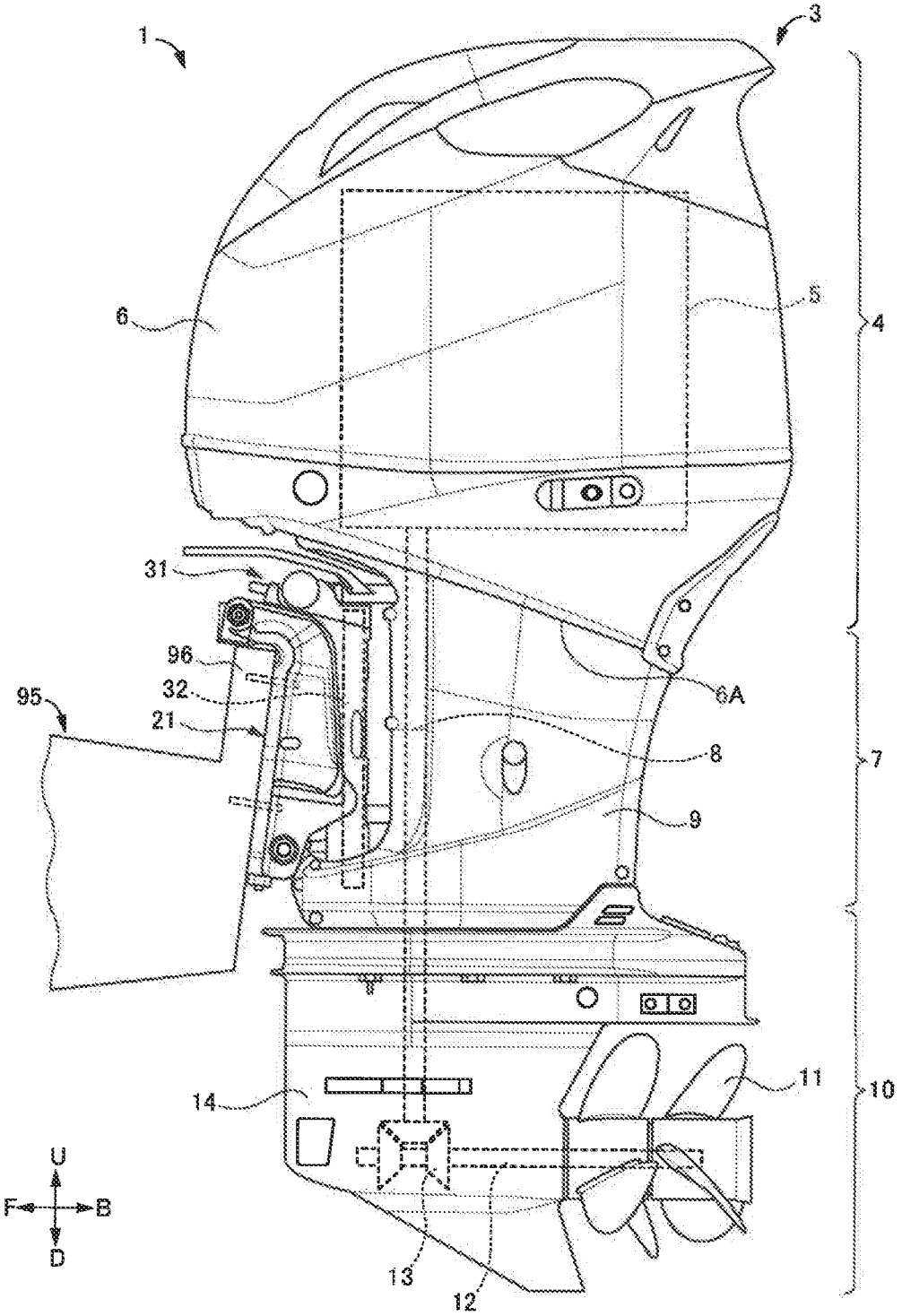
FIG. 1 is an overall view illustrating an outboard motor including a steering device according to an embodiment of the present disclosure.
Figure 2:
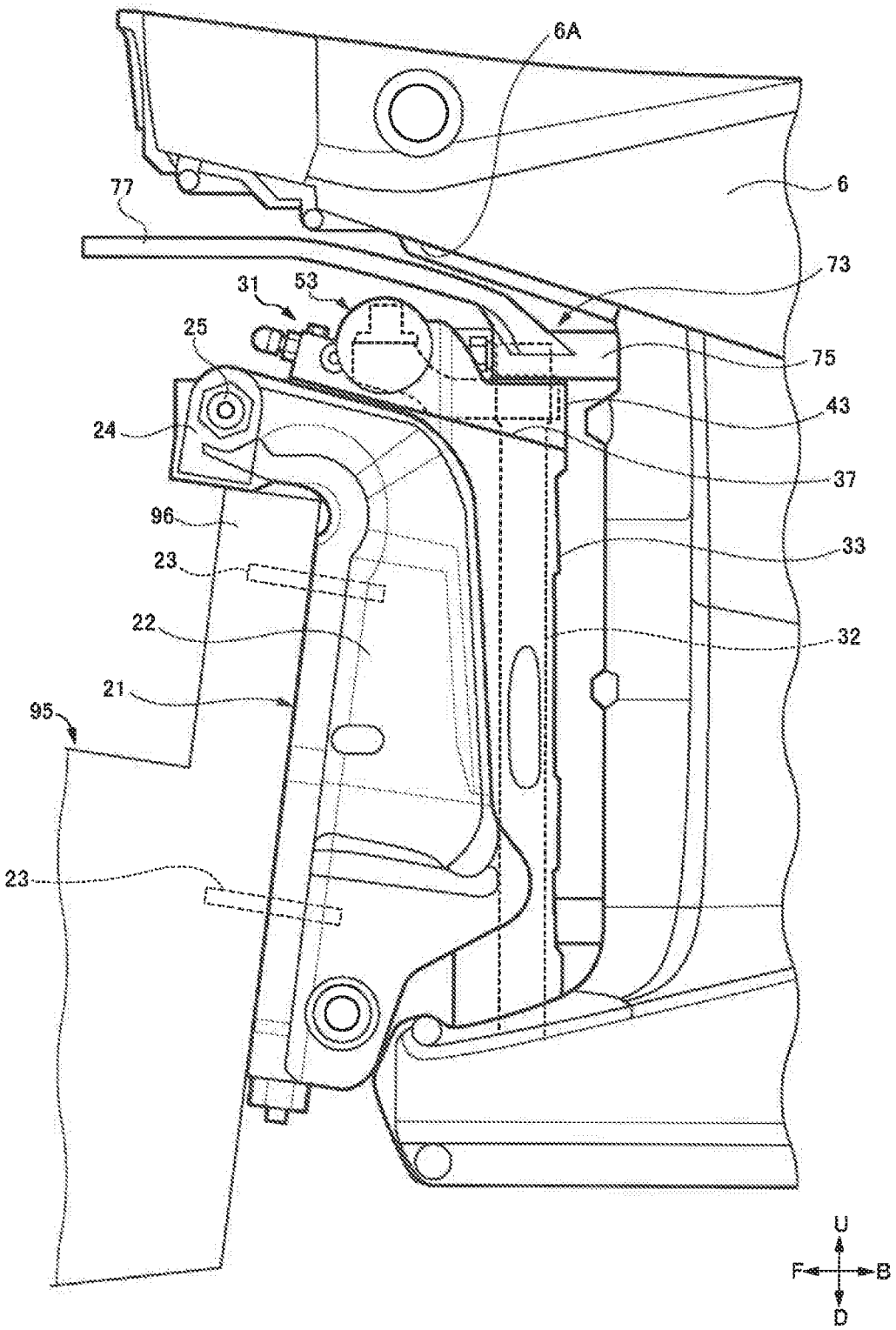
FIG. 2 is an enlarged view illustrating the steering device, a clamp bracket, and a part of an outboard motor main body according to the embodiment of the present disclosure in FIG. 1.

FIG. 1 illustrates an outboard motor 1 including a steering device 31 according to an embodiment of the present disclosure. FIG. 2 is an enlarged view of the steering device 31, a clamp bracket 21, and the like in FIG. 1.

As illustrated in FIG. 1, the outboard motor 1 includes an outboard motor main body 3, a steering device 31, and a clamp bracket 21.

An upper unit 4 constituting an upper part of the outboard motor main body 3 is provided with an engine 5 and an engine cover 6 that covers the engine 5. In addition, a middle unit 7 constituting an intermediate portion of the outboard motor main body 3 in an upper-lower direction is provided with a drive shaft 8 connected to a crankshaft of the engine 5, and a drive shaft housing 9 that accommodates the drive shaft 8. A lower unit 10 constituting a lower part of the outboard motor main body 3 is provided with a propeller 11, a propeller shaft 12, a gear mechanism 13 that transmits power of the drive shaft 8 to the propeller shaft 12, and a gear case 14 that accommodates the gear mechanism 13 and the like.

As illustrated in FIG. 2, the steering device 31 has a configuration in which a steering shaft 32 connected to the outboard motor main body is rotatably supported in a right-left direction by a swivel bracket 33, and rotation of the steering shaft 32 is controlled by a hydraulic cylinder device 53 provided in an upper portion of the swivel bracket 33. Details of the steering device 31 will be described below.

The clamp bracket 21 is a mechanism that fixes the swivel bracket 33 of the steering device 31 to a transom 96 of a boat hull 95. The clamp bracket 21 includes a fixing portion 22 that fixes the clamp bracket 21 itself to the transom 96 of the boat hull 95 using a fixing tool 23 such as a bolt, and a pair of left and right shaft support portions 24 (see FIG. 4) that tiltably connects the swivel bracket 33 via the tilt shaft 25. The outboard motor main body 3 is attached to the transom 96 of the boat hull 95 via the swivel bracket 33 of the steering device 31 and the clamp bracket 21.

Figure 3:
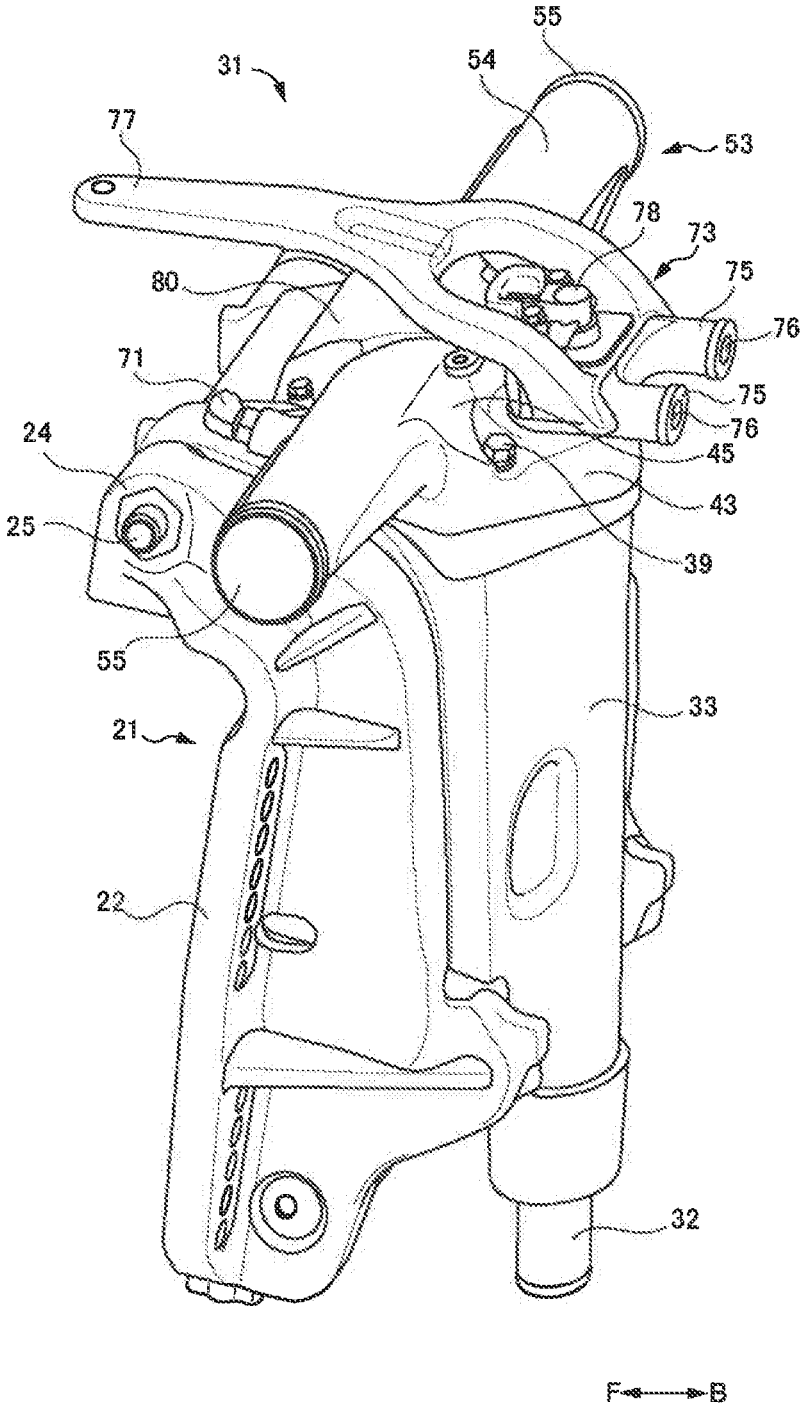
FIG. 3 is a perspective view illustrating the steering device and the clamp bracket according to the embodiment of the present disclosure.
Figure 4:
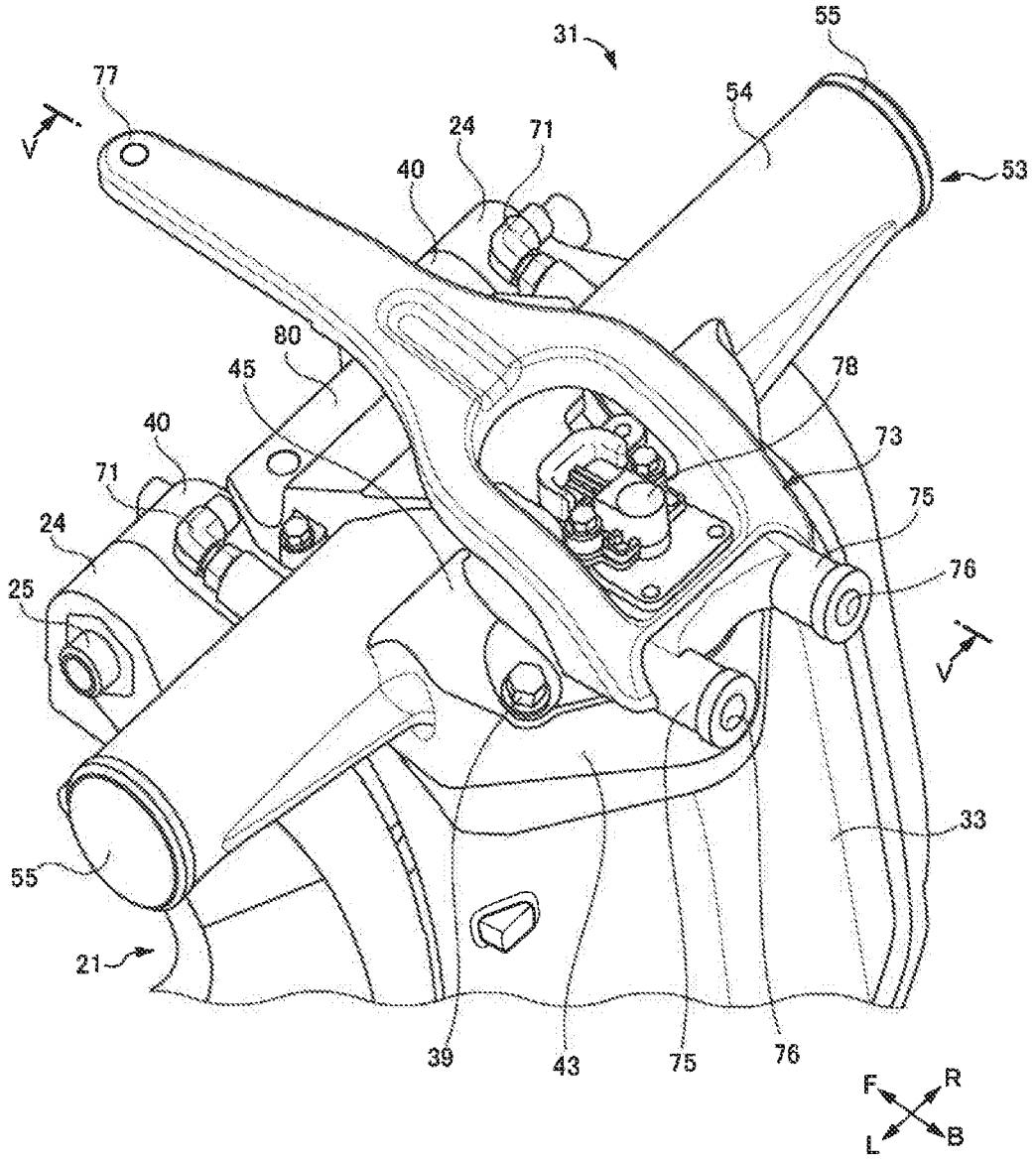
FIG. 4 is a perspective view illustrating the steering device of the embodiment of the present disclosure.
Figure 5:
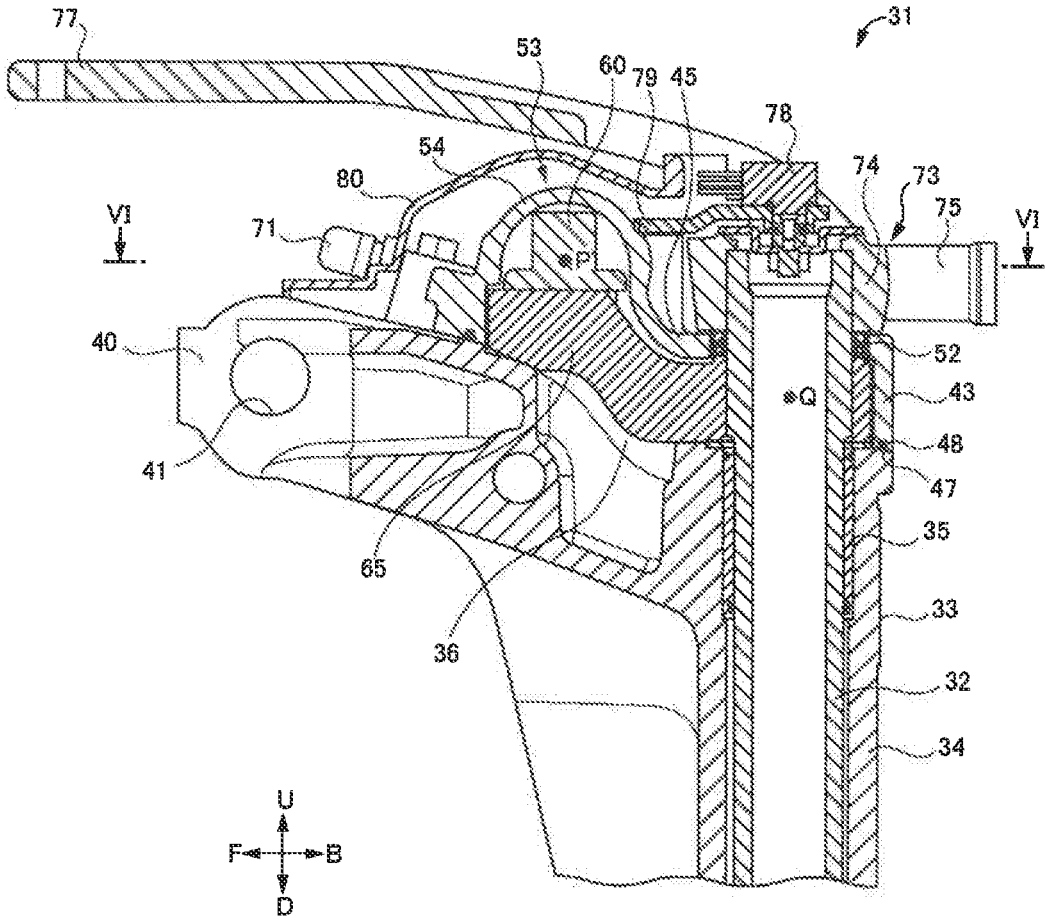
FIG. 5 is a cross-sectional view illustrating the steering device as viewed from the direction of the arrows V-V in FIG. 4.
Figure 6:
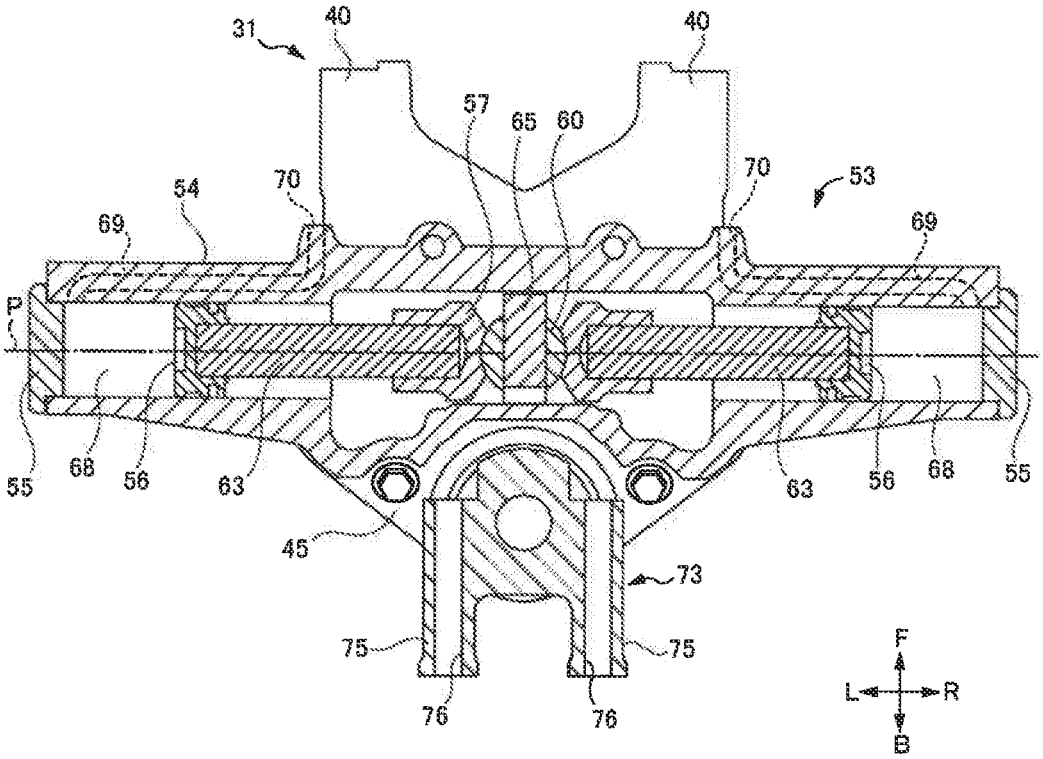
FIG. 6 is a cross-sectional view illustrating the steering device as viewed from the direction of arrows VI-VI in FIG. 5.
Figure 7:
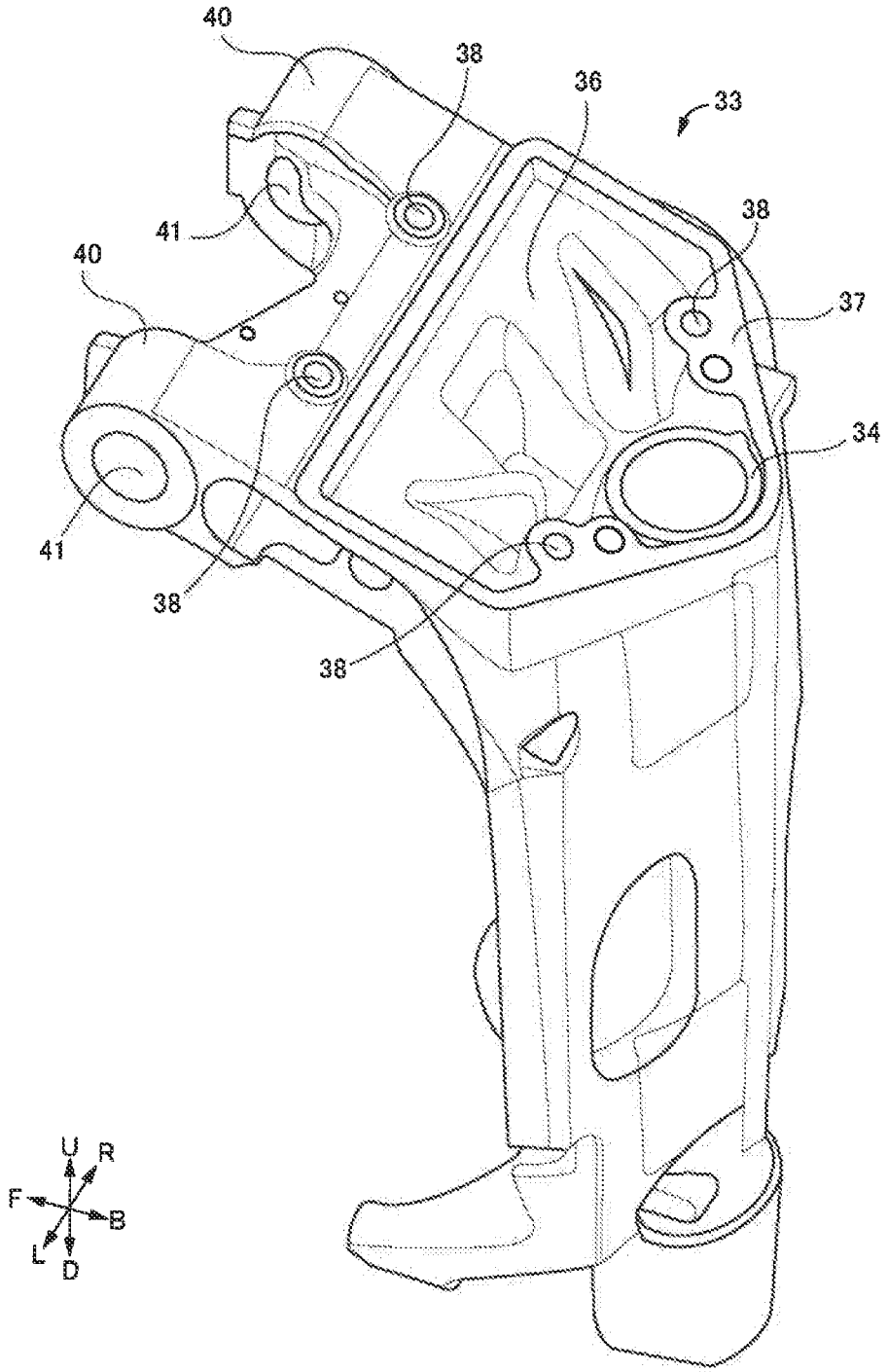
FIG. 7 is a perspective view illustrating a swivel bracket in the steering device according to the embodiment of the present disclosure.
Figure 8:
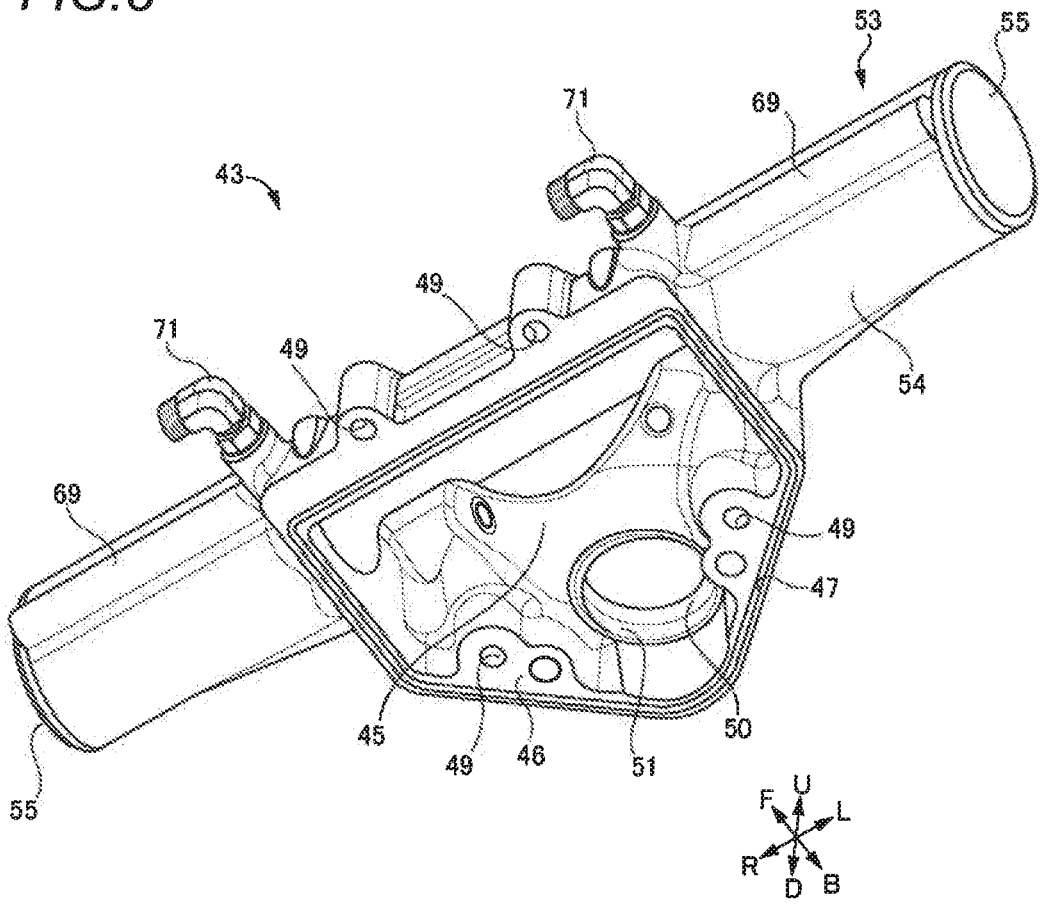
FIG. 8 is a perspective view illustrating a swivel bracket cover in the steering device of the embodiment of the present disclosure.

FIG. 3 illustrates the steering device 31 and the clamp bracket 21. FIG. 4 illustrates an upper portion of the steering device 31. FIG. 5 illustrates an upper portion of the steering device 31 as viewed from a direction of the arrows V-V in FIG. 4. FIG. 6 illustrates an upper portion of the steering device 31 as viewed from a direction of arrows VI-VI in FIG. 5. FIG. 7 illustrates the swivel bracket 33. FIG. 8 illustrates a swivel bracket cover 43.

As illustrated in FIGS. 3 to 6, the steering device 31 includes the steering shaft 32, the swivel bracket 33, the swivel bracket cover 43 serving as a cover member, the hydraulic cylinder device 53 serving as a steering actuator, an arm 65 serving as a power transmission mechanism, a steering bracket 73, a steering angle sensor 78, and an upper cover 80.

As illustrated in FIG. 5, the steering shaft 32 is a metallic cylindrical member extending in the upper-lower direction. An upper end portion of the steering shaft 32 is connected to a lower portion of the upper unit 4 or an upper portion of the middle unit 7 of the outboard motor main body 3 via a steering bracket 73. As illustrated in FIG. 2, a lower end portion of the steering shaft 32 is connected to a lower portion of the middle unit 7 of the outboard motor main body 3 via a bracket (not illustrated).

As illustrated in FIG. 7, the swivel bracket 33 is formed of, for example, a metal material and has a shape elongated in the upper-lower direction. A shaft support portion 34 for rotatably supporting the steering shaft 32 is formed at a substantially central portion of the swivel bracket 33 in the right-left direction. The shaft support portion 34 is formed into a cylindrical shape having an axis extending in the upper-lower direction. The steering shaft 32 is inserted into the shaft support portion 34. Further, as illustrated in FIG. 5, a bearing 35 for smoothly rotating the steering shaft 32 relative to the shaft support portion 34 is provided inside the shaft support portion 34.

As illustrated in FIG. 7, a steering mechanism accommodation portion 36, on which the hydraulic cylinder device is placed, is formed at a part from the upper side of the shaft support 34 to the front side of the shaft support portion 34 on an upper portion of the swivel bracket 33. The steering mechanism accommodation portion 36 accommodates the arm 65, a connection part between a slider 60 and the arm 65, and a connection part between the arm 65 and the steering shaft 32. The steering mechanism accommodation portion 36 has a bowl shape in which a central portion thereof is recessed, and an upper portion thereof is opened. A cover attachment surface 37 for attaching the swivel bracket cover 43 is formed on an upper surface of a peripheral edge of the steering mechanism accommodation portion 36. A plurality of attachment holes 38 for attaching a fixing member that fixes the swivel bracket cover 43 to the swivel bracket 33 are formed at the peripheral portion of the steering mechanism accommodation portion 36. The fixing member is, for example, a bolt 39 as illustrated in FIG. 4, and screws for fastening the bolt 39 are formed in the attachment holes 38.

A pair of left and right shaft support portions 40 for connecting the swivel bracket 33 to the clamp bracket 21 are provided in the upper front side of the swivel bracket 33. A tilt shaft insertion hole 41 for inserting the tilt shaft 25 is formed in each of the shaft support portions 40. The swivel bracket 33 can be rotated in the upper-lower direction relative to the clamp bracket 21, with the tilt shaft 25 serving as a rotation shaft. Accordingly, the outboard motor main body 3 and the steering device 31 can be inclined relative to the boat hull 95 to which the clamp bracket 21 is attached, and the tilt angle of the outboard motor main body 3 relative to the boat hull 95 can be changed. It should be noted that FIGS. 1, 2, 9, and 10 illustrate a state where the tilt angle of the outboard motor main body 3 is 0 degree.

As illustrated in FIG. 3, the swivel bracket cover 43 is attached to the upper portion of the swivel bracket 33 and covers the hydraulic cylinder device 53, the arm 65, a connection part between the hydraulic cylinder device 53 and the arm 65, and the connection part between the arm 65 and the steering shaft 32. The swivel bracket cover 43 is formed of, for example, a metal material. A cylinder 54 constituting a part of the hydraulic cylinder device 53 is formed at a front portion of the swivel bracket cover 43, and a steering mechanism cover portion 45 is formed at a back portion of the swivel bracket cover 43.

As illustrated in FIG. 8, the steering mechanism cover portion 45 is formed into a vertically inverted bowl shape, and a lower portion thereof is opened. The steering mechanism cover portion 45 is attached to an upper portion of the steering mechanism accommodation portion 36 from an upper side of the steering mechanism accommodation portion 36. A shape of the opening of the steering mechanism cover portion 45 matches a shape of the opening of the steering mechanism accommodation portion 36. A bracket attachment surface 46 formed on a lower surface of a peripheral edge of the steering mechanism cover portion 45 overlaps the cover attachment surface 37 of the steering mechanism accommodation portion 36.

A seal accommodation groove 47 is formed on the bracket attachment surface 46 over the entire peripheral thereof. As illustrated in FIG. 5, a seal member 48 that seals between the steering mechanism cover portion 45 and the steering mechanism accommodation portion 36 in a liquid-tight manner is provided in the seal accommodation groove 47. The seal member 48 is, for example, an O-ring formed of a rubber material. As illustrated in FIG. 8, a plurality of attachment holes 49 for passing a fixing member (bolt 39) that fixes the swivel bracket cover 43 to the swivel bracket 33 are formed at the peripheral portion of the steering mechanism cover portion 45.

A steering shaft insertion hole 50 for inserting the upper end portion of the steering shaft 32 is formed in the steering mechanism cover portion 45. A seal member arrangement portion 51 for disposing a seal member 52 is formed on the inner peripheral side of the steering shaft insertion hole 50. As illustrated in FIG. 5, the seal member 52 is disposed in the seal member arrangement portion 51. The seal member 52 seals the entire peripheral between an outer peripheral surface of the upper end portion of the steering shaft 32 and an inner peripheral surface of the steering shaft insertion hole 50 in a liquid-tight manner.

As illustrated in FIG. 5, the steering mechanism cover portion 45 is attached to an upper portion of the steering mechanism accommodation portion 36, and is fixed to the steering mechanism accommodation portion 36 by a bolt 39. The peripheral portion of the steering mechanism accommodation portion 36 and the peripheral portion of the steering mechanism cover portion 45 are sealed by a seal member 48 in a liquid-tight manner. The upper end portion of the steering shaft 32 is inserted into the steering shaft insertion hole 50, and the steering shaft insertion hole 50 and the steering shaft 32 are sealed by the seal member 52 in a liquid-tight manner. A diameter of the steering shaft insertion hole 50 is substantially the same as a diameter of the steering shaft 32, although there is a slight dimensional difference that allows rotation of the steering shaft 32. Therefore, a gap between the inner peripheral surface of the steering shaft insertion hole 50 and the outer peripheral surface of the steering shaft 32 can be reliably sealed by the seal member 48, and stability and durability of the seal can be easily enhanced. With such a configuration, a space sealed from the outside is formed between the steering mechanism accommodation portion 36 and the steering mechanism cover portion 45. The space accommodates the arm 65, and the connection part between the arm 65 and the steering shaft 32.

Figure 9:
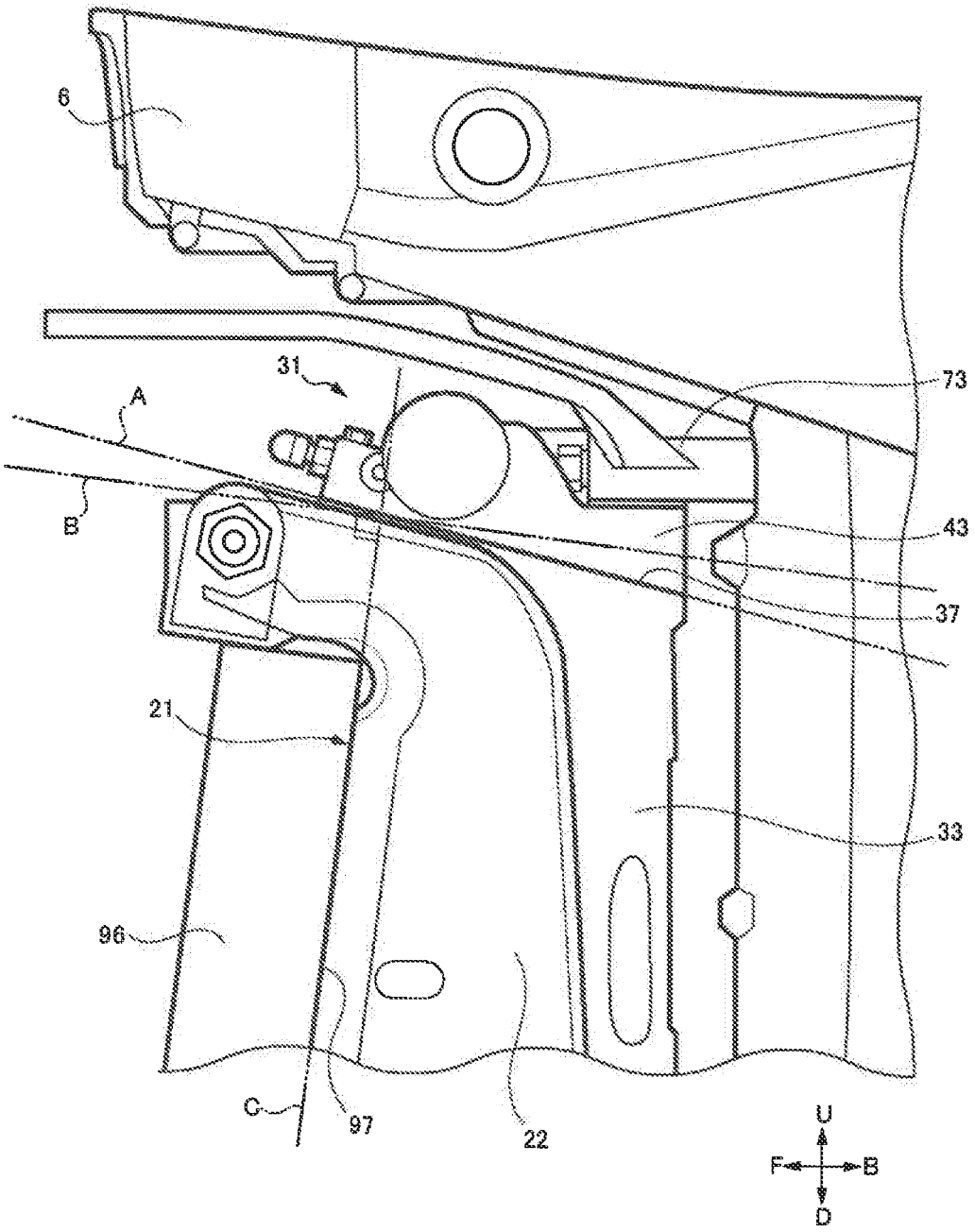
FIG. 9 is an illustrative view illustrating an inclination of a cover attachment surface of a swivel bracket in the steering device according to the embodiment of the present disclosure.

Here, as illustrated in FIG. 9, when the boat hull 95 to which the outboard motor 1 is attached is viewed from the lateral side, a straight line A parallel to the cover attachment surface 37 of the swivel bracket 33 is inclined such that the straight line A descends backward relative to a straight line B, which is orthogonal to a clamp bracket attachment surface 97 to which the clamp bracket 21 is attached in the transom 96, that is, a back surface of the transom 96, in a state where the tilt angle of the outboard motor main body 3 is 0 degree. When the boat hull 95 to which the outboard motor 1 is attached is viewed from the lateral side, a straight line C in FIG. 9 is parallel to the clamp bracket attachment surface 97.

Figure 10:
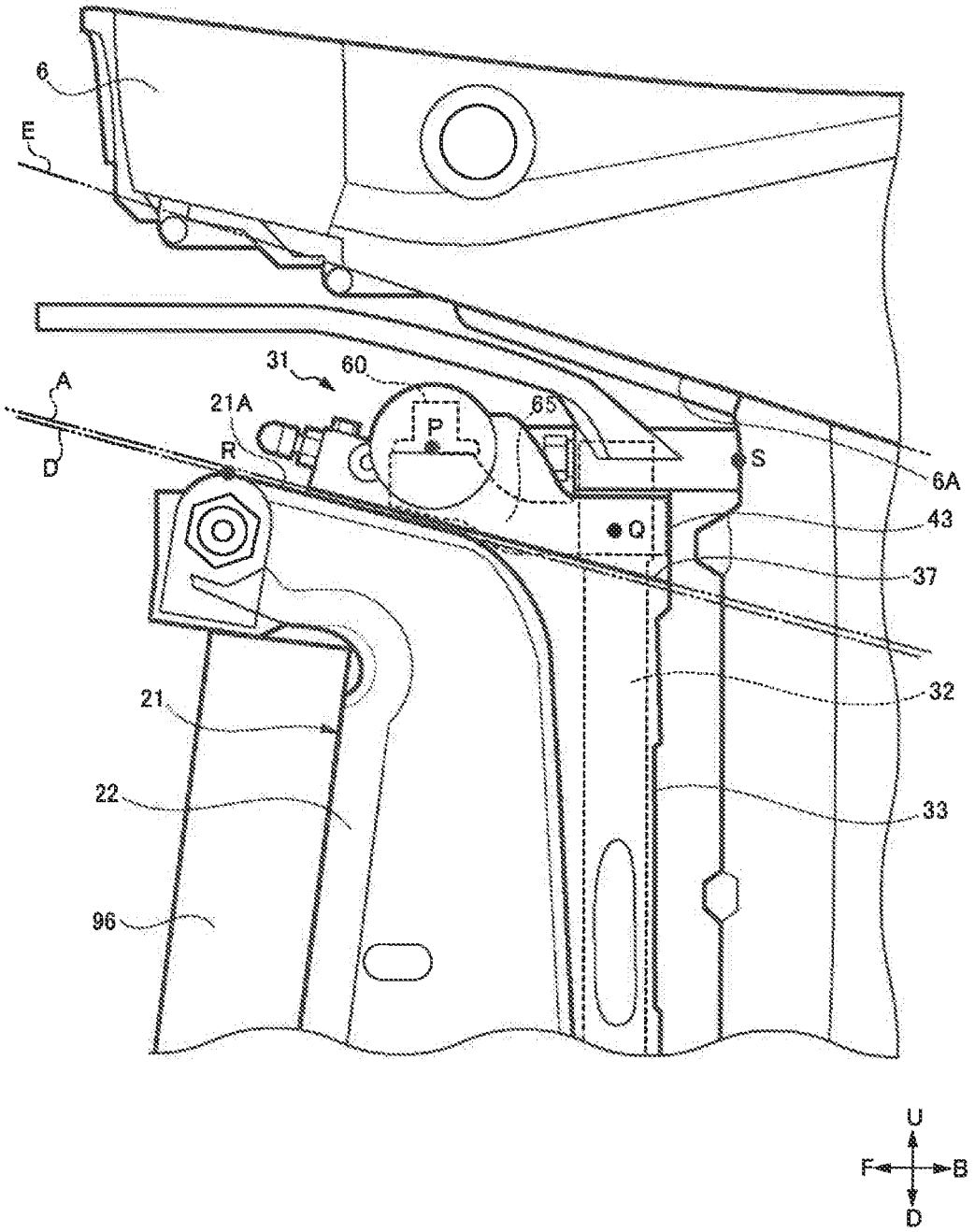
FIG. 10 is an illustrative view illustrating an inclination of the cover attachment surface of the swivel bracket in the steering device according to the embodiment of the present disclosure and a position of a connection part between an arm and a steering shaft relative to an axial center of a cylinder.

As illustrated in FIG. 10, when the boat hull 95 to which the outboard motor 1 is attached is viewed from the lateral side, the cover attachment surface 37 of the swivel bracket 33 is substantially parallel to an upper surface 21A of the clamp bracket 21 in a state where the tilt angle of the outboard motor main body 3 is 0 degree. In FIG. 10, a straight line A is parallel to the cover attachment surface 37 when the boat hull 95 to which the outboard motor 1 is attached is viewed from the lateral side, and a straight line D is parallel to the upper surface 21A of the clamp bracket 21 when the boat hull 95 to which the outboard motor 1 is attached is viewed from the lateral side. An upper portion of the clamp bracket 21 extends forward on the upper side of the transom 96. The upper flat surface of the forwardly extending portion is the upper surface 21A. The upper surface 21A of the clamp bracket 21 is inclined so as to descend backward from the front end portion of the upper surface 21A.

As illustrated in FIG. 10, when the boat hull 95 to which the outboard motor 1 is attached is viewed from the lateral side, the cover attachment surface 37 of the swivel bracket 33 is substantially parallel to a lower surface 6A of the engine cover 6 in the outboard motor main body 3. In FIG. 10, a straight line E is parallel to the lower surface 6A of the engine cover 6 when the boat hull 95 to which the outboard motor 1 is attached is viewed from the lateral side. As illustrated in FIG. 1, the engine cover 6 that covers the engine 5 has a dimension in the front-back direction and a dimension in the right-left direction larger than those of the drive shaft housing 9 that accommodates the drive shaft 8, in the outboard motor main body 3. Therefore, the front side and the back side of the engine cover 6 project forward and backward relative to the drive shaft housing 9, respectively, and the left side and the right side of the engine cover 6 project leftward and rightward relative to the drive shaft housing 9, respectively. Therefore, in the engine cover 6, the lower surface 6A is formed on a lower portion of parts projecting forward, backward, leftward, and rightward relative to the drive shaft housing 9. The lower surface 6A is a flat surface, and is inclined so as to descend backward as illustrated in FIG. 1.

The hydraulic cylinder device 53 is a device that generates power for rotating the outboard motor main body 3 in the right-left direction to change a steering angle of the outboard motor main body 3. As illustrated in FIG. 6, the hydraulic cylinder device 53 includes a cylinder 54, a pair of pistons 56, a slider connection member 57, a pair of rods 63, and a slider 60 as a moving body. The cylinder 54 is disposed on the upper portion of the swivel bracket 33. Specifically, as illustrated in FIG. 4, the cylinder 54 is formed integrally with the front portion of the swivel bracket cover 43. The cylinder 54 is formed into a cylindrical shape, and an axis line of the cylinder 54 extends in the right-left direction. The cylinder 54 is disposed such that a center portion of the cylinder 54 in the right-left direction matches a central portion of the swivel bracket 33 in the right-left direction. Two caps 55 are attached to two end portions of the cylinder 54 in the right-left direction, respectively. Accordingly, a liquid-tight space is formed in the cylinder 54. As illustrated in FIG. 5, the lower portion of the center portion of the cylinder 54 in the right-left direction is in communication with a liquid-tight space formed between the steering mechanism accommodation portion 36 and the steering mechanism cover portion 45. As illustrated in FIG. 6, the pair of pistons 56, the slider connection member 57, the pair of rods 63, and the slider 60 are provided in the cylinder 54.

The arm 65 has a function of transmitting the power of the hydraulic cylinder device 53 to the steering shaft 32. The arm 65 is disposed on the upper portion of the swivel bracket 33. The arm 65 is entirely disposed in a space formed between the swivel bracket 33 and the swivel bracket cover 43. Specifically, as illustrated in FIG. 5, a front end portion of the arm 65 is disposed in the center portion of the space in the cylinder 54 in the right-left direction, and a back end portion of the arm 65 is disposed in the space formed between the steering mechanism accommodation portion 36 and the steering mechanism cover portion 45.

Figure 11:
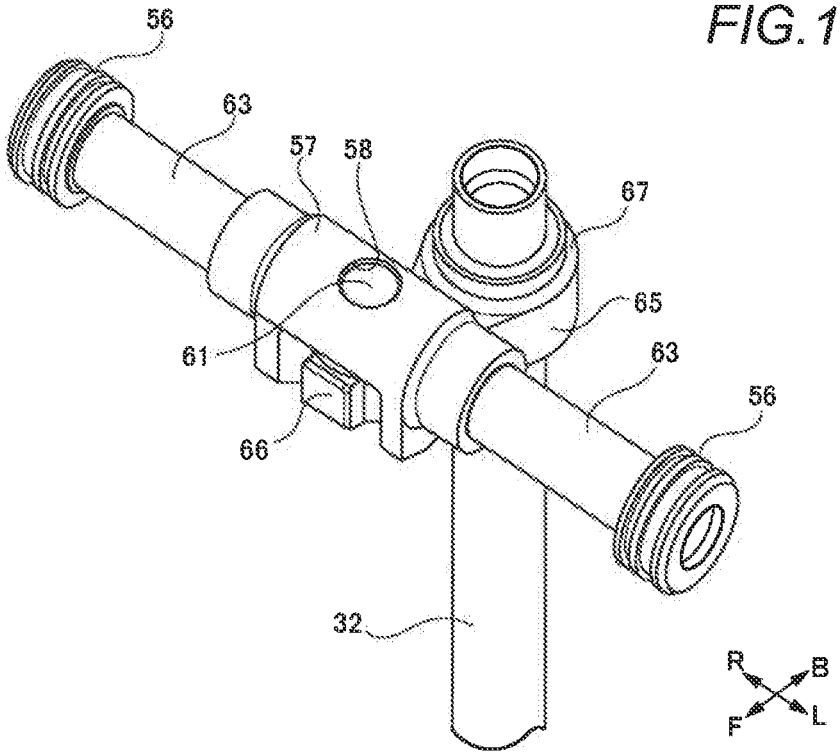
FIG. 11 is a perspective view illustrating a piston, a slider connection member, a rod, a slider, an arm, and a steering shaft in a hydraulic cylinder device of the steering device according to the embodiment of the present disclosure.
Figure 12:
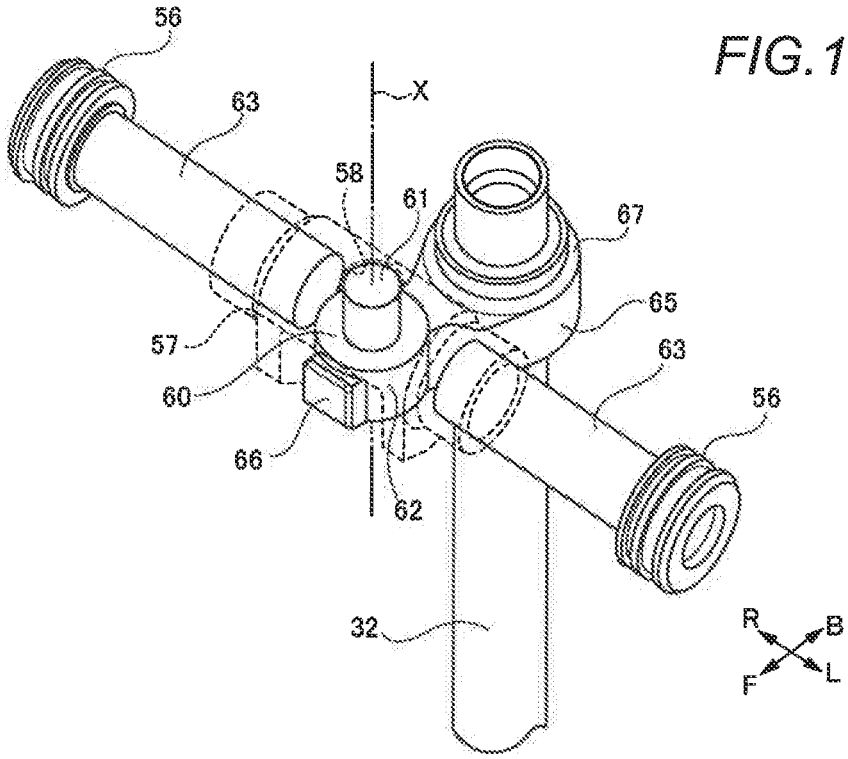
FIG. 12 is a perspective view illustrating the piston, the rod, the slider, the arm, and the steering shaft in the hydraulic cylinder device of the steering device according to the embodiment of the present disclosure.
Figure 13:
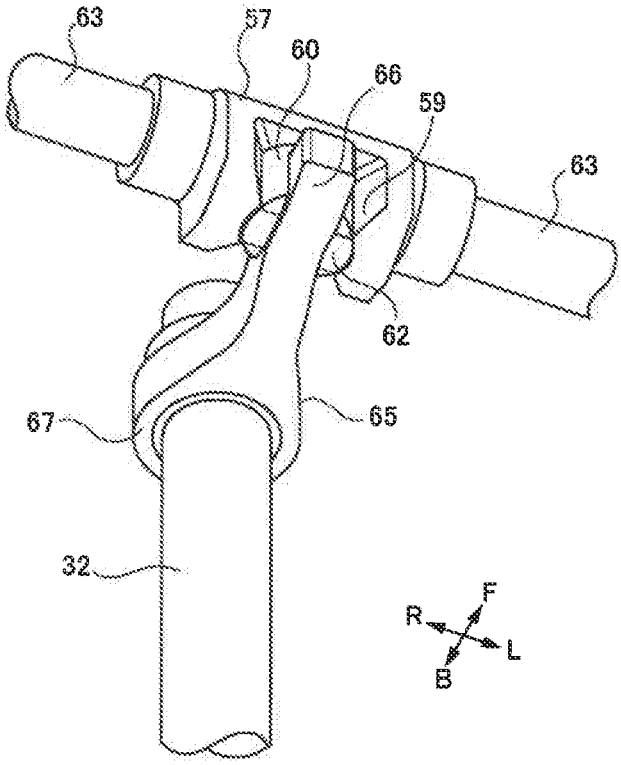
FIG. 13 is a perspective view illustrating the slider connection member, the rod, the slider, the arm, and the steering shaft in the hydraulic cylinder device of the steering device according to the embodiment of the present disclosure.

Here, FIG. 11 illustrates a state where the pair of pistons 56, the slider connection member 57, the pair of rods 63, the slider 60, and the upper end portion of the steering shaft 32 are viewed obliquely from above. FIG. 12 illustrates a state where the slider connection member 57 in FIG. 11 is seen through. FIG. 13 illustrates a state where the slider connection member 57, the pair of rods 63, the slider 60, and the upper end portion of the steering shaft 32 are viewed obliquely from bottom.

As illustrated in FIG. 11, in the cylinder 54, the pair of pistons 56 are respectively disposed on the left and right sides of the slider connection member 57, and the pistons 56 are connected and fixed to the slider connection member 57 by the rods 63. With this structure, the pair of pistons 56, the slider connection member 57, and the pair of rods 63 can be integrated and moved in the right-left direction in the cylinder 54.

The slider connection member 57 is formed of, for example, a metal material or a resin material, and, as illustrated in FIG. 11, a connection hole 58 for inserting a head portion 61 of the slider 60 is formed on an upper portion of the slider connection member 57. As illustrated in FIG. 13, a connection recessed portion 59 for inserting leg portions 62 of the slider 60 is formed on a lower portion of the slider connection member 57. The slider 60 is formed of, for example, a metal material or a resin material, and, as illustrated in FIG. 11 or 12, and the cylindrical head portion 61 is formed on an upper portion of the slider 60, and leg portions 62 branched into two sections are formed on a lower portion of the slider 60. In the cylinder 54, the slider 60 is connected to the slider connection member 57 by inserting the head portion 61 into the connection hole 58 and inserting the leg portions 62 into the connection recessed portion 59. The head portion 61 of the slider 60 is not fixed into the connection hole 58, and the leg portions 62 of the slider 60 is not fixed to the connection recessed portion 59 either. The slider 60 can be rotated relative to the slider connection member 57 with an axis line X of the slider 60 (see FIG. 12) set as a rotation axis.

The arm 65 is formed of, for example, a metal material or a resin material. A column portion 66 extending in the front-back direction is formed at a front end portion of the arm 65. In the cylinder 54, the column portion 66 is inserted slidably in the front-back direction between the leg portions 62 of the slider 60 branched into two sections. On the other hand, an annular coupling portion 67 is formed at the back end portion of the arm 65. In the space formed between the steering mechanism accommodation portion 36 and the steering mechanism cover portion 45, the coupling portion 67 is connected to the upper end portion of the steering shaft 32 by inserting the upper end portion of the steering shaft 32 into the coupling portion 67. The coupling portion 67 is fixed to the upper end portion of the steering shaft 32 by, for example, spline coupling or welding. Accordingly, the arm 65 rotates integrally with the steering shaft 32.

Further, as illustrated in FIG. 6, oil chambers 68 are formed at a portion on the left side of the left piston and a portion on the right side of the right piston in the cylinder 54, respectively. Oil passages 69 in communication with the oil chambers 68 are formed in the cylinder 54. Each of the oil passages 69 is formed in a front portion of a peripheral wall portion of the cylinder 54. Further, oil ports 70 for connecting hydraulic circuits provided outside the steering device 31 to the oil passages 69 are disposed in front portions of the cylinder 54, and hydraulic unions 71 are connected to the oil ports 70 as illustrated an FIG. 4.

According to pressure of hydraulic oil supplied (input) to either of the two oil passages 69 from the hydraulic circuit provided outside the steering device 31, the pair of pistons 56, the slider connection member 57, and the pair of rods 63 move leftward or rightward in the cylinder 54. Accordingly, the slider 60 moves leftward or rightward in the cylinder 54. The movement of the slider 60 in the right-left direction is transmitted to the steering shaft 32 by the arm 65 and is converted into rotation of the steering shaft 32. Accordingly, the steering shaft 32 is rotated.

Here, as illustrated an FIG. 10, when the boat hull 95 to which the outboard motor 1 is attached is viewed from the lateral side, an axial center P of the cylinder 54 is located at a back side of the transom 96 in a state where the tilt angle of the outboard motor main body 3 is 0 degree. As illustrated in FIG. 5, when the boat hull 95 to which the outboard motor 1 is attached is viewed from the lateral side, a portion between the front end portion and the back end portion of the arm 65 is bent into a crank shape, and the back end portion of the arm 65 is located lower than the front end portion thereof. As a result, when the boat hull 95 to which the outboard motor 1 is attached is viewed from the lateral side, a connection part Q between the arm 65 and the steering shaft 32 is located lower than the axial center P of the cylinder 54. When the boat hull 95 to which the outboard motor 1 is attached is viewed from the lateral side, the connection part Q between the arm 65 and the steering shaft 32 is located lower than an upper end portion R of the clamp bracket 21 in a state where the tilt angle of the outboard motor main body 3 is 0 degree.

As illustrated in FIG. 2, the steering bracket 73 is a member that connects the upper end portion of the steering shaft 32 to the outboard motor main body 3. The steering bracket 73 is formed of, for example, a metal material, and includes a steering shaft connection portion 74, a pair of body connection portions 75, and a tie bar connection portion 77, as illustrated in FIG. 5.

The steering shaft connection portion 74 is formed into a cylindrical shape having an axis extending in the upper-lower direction, and an upper end portion of the steering shaft 32, which passes through the steering shaft insertion hole 50 of the swivel bracket cover 43 and extends upward, is inserted into the steering shaft connection portion 74. The steering shaft connection portion 74 is fixed to the upper end portion of the steering shaft 32 by, for example, spline coupling or welding.

As illustrated in FIG. 4, the pair of body connection portions 75 are disposed side by side in the right-left direction. Each of the body connection portions 75 is formed into a columnar shape extending in the front-back direction, and an attachment hole 76 penetrating each of the body connection portions 75 in the front-back direction is formed in each of the body connection portions 75. The back end portion of each of the body connection portions 75 is connected to the outboard motor main body 3 by inserting a bolt or the like into the attachment hole 76 of each of the body connection portions 75 and fastening the bolt to the outboard motor main body 3. Here, as illustrated in FIG. 10, the position of the axial center P of the cylinder 54 in the upper-lower direction is substantially the same as the position of the connection part S between the steering bracket 73 and the outboard motor main body 3 in the upper-lower direction.

As illustrated in FIG. 2, a back end side of the tie bar connection portion 77 is connected to an upper portion of the steering shaft connection portion 74 located at the upper side of the steering shaft 32. A front end side of the tie bar connection portion 77 extends forward from the upper side of the steering shaft 32, passing through the upper side of the swivel bracket cover 43, specifically, between the swivel bracket cover 43 and the lower surface 6A of the engine cover 6. When two or more outboard motors 1 are attached to the boat hull 95, a tie bar for matching the steering timings and the steering amounts of the two or more outboard motors can be attached to the front end portion of the tie bar connection portion 77.

Further, as illustrated in FIG. 5, a steering angle sensor 78 for detecting a steering angle (rotation angle of the steering shaft 32) is provided in the upper side of the steering shaft 32. The steering angle sensor 78 is fixed to the swivel bracket cover 43 via an attachment plate 79. An upper cover 80 is attached to an upper side of a front portion of the swivel bracket cover 43. A cable or the like connected to the steering angle sensor 78 is wired between the swivel bracket cover 43 and an up cover 80.

As described above, the steering device 31 of the embodiment of the present disclosure has a configuration in which the hydraulic cylinder device 53, the arm 65, the connection part between the arm 65 and the slider 60, and the connection part between the arm 65 and the steering shaft 32 are disposed in a liquid-tight space between the swivel bracket 33 and the swivel bracket cover 43. With this configuration, water such as seawater is prevented from infiltrating into the space between the swivel bracket 33 and the swivel bracket cover 43. Accordingly, water is prevented from infiltrating into the cylinder 54 of the hydraulic cylinder device 53, and the arm 65, the connection part between the arm 65 and the slider 60, or the connection part between the arm 65 and the steering shaft 32 are prevented from coming into contact with water. As described above, according to the steering device of the embodiment of the present disclosure, it is possible to improve durability against water such as seawater.

In the steering device 31 of the embodiment of the present disclosure, the entire arm 65, whose front end portion moves in the right-left direction by the movement of the slider 60 of the hydraulic cylinder device 53, is accommodated in the fluid-tight space between the swivel bracket 33 and the swivel bracket cover 43. Therefore, it is not necessary to form an opening that communicates with the outside of the swivel bracket and has a dimension substantially larger than the diameter of the arm, like the hydraulic steering device described in Patent Document 1. Therefore, according to the steering device 31 of the embodiment of the present disclosure, it is possible to improve the durability against water such as seawater compared with the hydraulic steering device described in Patent Document 1.

According to the steering device 31 of the embodiment of the present disclosure, the hydraulic cylinder device 53 and the arm 65 are disposed on the upper portion of the swivel bracket 33, and these components are accommodated between the swivel bracket 33 and the engine cover 6, and thereby the steering device 31 or the outboard motor 1 can be downsized.

Further, according to the steering device 31 of the embodiment of the present disclosure, the cylinder 54 of the hydraulic cylinder device 53 is disposed such that the axis line of the cylinder 54 extends in the right-left direction of the boat hull 95. Accordingly, the hydraulic cylinder device 53 can be prevented from projecting toward the bow side, and a wide boarding space or a loading space can be ensured at the stern of the boat hull 95.

According to the steering device 31 of the embodiment of the present disclosure, the cylinder 54 of the hydraulic cylinder device 53 is integrally formed on the swivel bracket cover 43, and the arm 65 and the connection part between the arm 65 and the steering shaft 32 are accommodated between the steering mechanism accommodation portion 36 formed on the swivel bracket 33 and the steering mechanism cover portion 45 formed on the swivel bracket cover 43, so that the steering device 31 or the outboard motor 1 can be downsized. According to this configuration, the hydraulic cylinder device 53 can be disposed at a position close to the steering shaft 32, so that the required range of the steering angle of the outboard motor main body 3 can be ensured, the moving amount of the slider 60 can be reduced, and the cylinder 54 can be shortened in the axial direction thereof. The dimension of the steering device 31 or the outboard motor 1 in the right-left direction can be reduced by shortening the cylinder 54. Therefore, when two or more outboard motors 1 are disposed side by side in the right-left direction, the space required for the arrangement of two or more outboard motors can be reduced.

In the steering device 31 of the embodiment of the present disclosure, as illustrated in FIG. 10, when the boat hull 95 to which the outboard motor 1 is attached is viewed from the lateral side, the axial center P of the cylinder 54 is located at the back side of the transom 96, and the connection part Q between the arm 65 and the steering shaft 32 is located lower than the axial center P of the cylinder 54. According to this configuration, the hydraulic cylinder device 53 can be disposed further backward relative to the boat hull 95, and the hydraulic cylinder device 53 or the hydraulic piping connected to the hydraulic cylinder device 53 can be prevented from projecting to the boarding space or the loading space of the boat hull 95. In addition, the steering device 31 can be inclined downward and backward, and thus the dimension of the outboard motor 1 in the front-back direction can be shortened and the outboard motor can be downsized as compared with a case where the steering device 31 is disposed horizontally.

In the steering device 31 of the embodiment of the present disclosure, as illustrated in FIG. 10, when the boat hull 95 to which the outboard motor 1 is attached is viewed from the lateral side, the connection part Q between the arm 65 and the steering shaft 32 is located lower than the upper end portion R of the clamp bracket 21. Also with this configuration, the steering device 31 can be inclined downward and backward, and thus the dimension of the outboard motor 1 in the front-back direction can be shortened and the outboard motor can be downsized as compared with the case where the steering device 31 is disposed horizontally.

In the steering device 31 of the embodiment of the present disclosure, as illustrated in FIG. 10, the position of the axial center P of the cylinder 54 in the upper-lower direction is substantially the same as the position of the connection part S between the steering bracket 73 and the outboard motor main body 3 in the upper-lower direction. According to this configuration, the height of the outboard motor main body 3 can be reduced.

In the steering device 31 of the embodiment of the present disclosure, as illustrated in FIG. 2, the tie bar connection portion 77 is provided in the steering bracket 73, and the tie bar connection portion 77 extends forward from the upper side of the steering shaft 32, passing through the upper side of the swivel bracket cover 43. With this configuration, the tie bar connection portion 77 can be disposed between the swivel bracket cover 43 and the engine cover 6, and the tie bar connected to the tie bar connection portion 77 can be prevented from projecting toward the bow side of the boat hull 95.

In the steering device 31 of the embodiment of the present disclosure, as illustrated in FIG. 9, when the boat hull 95 to which the outboard motor 1 is attached is viewed from the lateral side, the straight line A parallel to the cover attachment surface 37 of the swivel bracket 33 is inclined so as to descend backward relative to the straight line B orthogonal to the clamp bracket attachment surface 46 of the transom 96. With this configuration, the steering device 31 can be inclined downward and backward, and thus the dimension of the outboard motor 1 in the front-back direction can be shortened and the outboard motor can be downsized as compared with the case where the steering device 31 is arranged horizontally.

In the steering device 31 of the embodiment of the present disclosure, as illustrated in FIG. 10, when the boat hull 95 to which the outboard motor 1 is attached is viewed from the lateral side, the cover attachment surface 37 of the swivel bracket is substantially parallel to the upper surface 21A of the clamp bracket 21, which is inclined so as to descend backward. Also with this configuration, the steering device 31 can be inclined downward and backward, and thus the dimension of the outboard motor 1 in the front-back direction can be shortened and the outboard motor can be downsized as compared with the case where the steering device 31 is disposed horizontally.

In the steering device 31 of the embodiment of the present disclosure, as illustrated in FIG. 10, when the boat hull 95 to which the outboard motor 1 is attached is viewed from the lateral side, the cover attachment surface 37 of the swivel bracket is substantially parallel to the lower surface 6A of the engine cover 6 in the outboard motor main body 3, which is inclined so as to descend backward. Also with this configuration, the steering device 31 can be inclined downward and backward, and thus the dimension of the outboard motor 1 in the front-back direction can be shortened and the outboard motor can be downsized as compared with the case where the steering device 31 is disposed horizontally.

Instead of the hydraulic cylinder device 53, an electric actuator that moves the slider (moving body) in the right-left direction by an electric motor may be used as the steering actuator.

The present disclosure can be modified as appropriate without departing from the scope or spirit of the invention which can be read from the claims and the entire specification, and the steering device of the outboard motor with such a change is also contained in the technical idea of the present invention.

What is claimed is:

1. A steering device of an outboard motor configured to be attached to a boat hull, the steering device comprising:

a steering shaft to which an outboard motor main body is connected;

a swivel bracket configured to be attached to a side of the boat hull and supporting the steering shaft;

a steering actuator disposed above the swivel bracket and configured to generate power in accordance with input from outside;

a power transmission mechanism disposed above the swivel bracket, connecting the steering actuator to the steering shaft, and configured to transmit the power of the steering actuator to the steering shaft; and a cover member attached to an upper portion of the swivel bracket to cover the steering actuator, the power transmission mechanism, a connection part between the steering actuator and the power transmission mechanism, and a connection part between the power transmission mechanism and the steering shaft, wherein a straight line parallel to a cover attachment surface to which the cover member is attached on an upper surface of the swivel bracket is inclined so as to descend backward relative to a straight line orthogonal to a clamp bracket attachment surface to which a clamp bracket configured to fix the swivel bracket to the boat hull is attached in the transom of the boat hull, when the boat hull to which the outboard motor is attached is viewed from a lateral side.

2. The steering device according to claim 1, wherein the steering actuator includes a cylinder disposed such that an axis line thereof extends in the right-left direction of the boat hull, and a moving body configured to move in the right-left direction in the cylinder in accordance with the input from the outside, and wherein the power transmission mechanism includes an arm connecting the moving body to the steering shaft.

3. The steering device according to claim 2, wherein the cylinder is formed at a front portion of the cover member, and a steering mechanism cover portion accommodating the arm and a connection part between the arm and the steering shaft is formed at a back portion of the cover member.

4. The steering device according to claim 2, wherein an axial center of the cylinder is located backward relative to a transom of the boat hull and the connection part between the arm and the steering shaft is located lower than the axial center of the cylinder, when the boat hull to which the outboard motor is attached is viewed from a lateral side.

5. The steering device according to claim 2, further comprising a steering bracket connecting an upper end portion of the steering shaft to the outboard motor main body, wherein a position of the axial center of the cylinder in an upper-lower direction is substantially the same as a position of a connection part between the steering bracket and the outboard motor main body in the upper-lower direction.

6. The steering device according to claim 5, wherein the steering bracket is provided with a tie bar connection portion, and the tie bar connection portion extends forward from an upper side of the steering shaft, passing through an upper side of the cover member.

7. The steering device according to claim 2, wherein a connection part between the arm and the steering shaft is located lower than an upper end portion of a clamp bracket configured to fix the swivel bracket to the boat hull, when the boat hull to which the outboard motor is attached is viewed from a lateral side.

8. The steering device according to claim 1, wherein an engine and an engine cover configured to cover the engine are provided in an upper portion of the outboard motor main body, wherein a drive shaft configured to transmit power of the engine to a propeller and a drive shaft housing covering the drive shaft are provided in an intermediate portion of the outboard motor main body in an upper-lower direction, wherein a gear mechanism configured to transmit the power of the engine, which is transmitted via the drive shaft to a propeller shaft configured to drive the propeller and a gear case covering the gear mechanism are provided in the lower portion of the outboard motor main body, and wherein a cover attachment surface to which the cover member is attached on an upper surface of the swivel bracket is substantially parallel to a lower surface of the engine cover in the outboard motor main body.

9. A steering device of an outboard motor configured to be attached to a boat hull, the steering device comprising:

a steering shaft to which an outboard motor main body is connected;

a swivel bracket configured to be attached to a side of the boat hull and supporting the steering shaft;

a steering actuator disposed above the swivel bracket and configured to generate power in accordance with input from outside;

a power transmission mechanism disposed above the swivel bracket, connecting the steering actuator to the steering shaft, and configured to transmit the power of the steering actuator to the steering shaft; and a cover member attached to an upper portion of the swivel bracket to cover the steering actuator, the power transmission mechanism, a connection part between the steering actuator and the power transmission mechanism, and a connection part between the power transmission mechanism and the steering shaft, wherein a cover attachment surface to which the cover member is attached on an upper surface of the swivel bracket is substantially parallel to an upper surface of a clamp bracket configured to fix the swivel bracket to the boat hull, when the boat hull to which the outboard motor is attached is viewed from the lateral side.

10. The steering device according to claim 9, wherein the steering actuator includes a cylinder disposed such that an axis line thereof extends in the right-left direction of the boat hull, and a moving body configured to move in the right-left direction in the cylinder in accordance with the input from the outside, and wherein the power transmission mechanism includes an arm connecting the moving body to the steering shaft.

11. The steering device according to claim 10, wherein the cylinder is formed at a front portion of the cover member, and a steering mechanism cover portion accommodating the arm and a connection part between the arm and the steering shaft is formed at a back portion of the cover member.

12. The steering device according to claim 10, wherein an axial center of the cylinder is located backward relative to a transom of the boat hull and the connection part between the arm and the steering shaft is located lower than the axial center of the cylinder, when the boat hull to which the outboard motor is attached is viewed from a lateral side.

13. The steering device according to claim 10, further comprising a steering bracket connecting an upper end portion of the steering shaft to the outboard motor main body, wherein a position of the axial center of the cylinder in an upper-lower direction is substantially the same as a position of a connection part between the steering bracket and the outboard motor main body in the upper-lower direction.

14. The steering device according to claim 13, wherein the steering bracket is provided with a tie bar connection portion, and the tie bar connection portion extends forward from an upper side of the steering shaft, passing through an upper side of the cover member.

15. The steering device according to claim 10, wherein a connection part between the arm and the steering shaft is located lower than an upper end, portion of a clamp bracket configured to fix the swivel bracket to the boat hull, when the boat hull to which the outboard motor is attached is viewed from a lateral side.

16. The steering device according to claim 9, wherein an engine and an engine cover configured to cover the engine are provided in an upper portion of the outboard motor main body, wherein a drive shaft configured to transmit power of the engine to a propeller and a drive shaft housing covering the drive shaft are provided in an intermediate portion of the outboard motor main body in an upper-lower direction, wherein a gear mechanism configured to transmit the power of the engine, which is transmitted via the drive shaft to a propeller shaft configured to drive the propeller and a gear case covering the gear mechanism are provided in the lower portion of the outboard motor main body, and wherein a cover attachment surface to which the cover member is attached on an upper surface of the swivel bracket is substantially parallel to a lower surface of the engine cover in the outboard motor main body.

* * * * *